US005775088A

United States Patent [19]

Grosz

[11] Patent Number: 5,775,088

[45] Date of Patent: Jul. 7, 1998

[54] JEWELRY ROPE CHAIN CUTTING TOOL

[76] Inventor: Robert Grosz, 22906 Banyan Pl. 190, Saugus, Calif. 91350

[21] Appl. No.: 592,843

[22] Filed: Jan. 22, 1996

[51] Int. Cl.[6] ..... B21L 7/00; B21L 19/00

[52] U.S. Cl. ..... 59/23; 59/35.1

[58] Field of Search ..... 59/80, 35.1, 23, 59/20

[56] References Cited

U.S. PATENT DOCUMENTS

| | | | |
|---|---|---|---|
| 1,244,448 | 10/1917 | Berg | 59/23 |
| 4,503,664 | 3/1985 | Allazzetta | 59/16 |
| 5,125,225 | 6/1992 | Strobel | 59/35.1 |
| 5,129,220 | 7/1992 | Strobel | 59/80 |
| 5,285,625 | 2/1994 | Ofrat et al. | 59/80 |
| 5,353,584 | 10/1994 | Strobel | 59/80 |
| 5,605,038 | 2/1997 | Rozenwasser | 59/80 |

FOREIGN PATENT DOCUMENTS

| | | | |
|---|---|---|---|
| 445969 | 7/1912 | France | 59/24 |
| 919469 | 2/1963 | United Kingdom | 59/23 |

*Primary Examiner*—David Jones
*Attorney, Agent, or Firm*—Alfred M. Walker

[57] ABSTRACT

A semi-solid jewelry chain includes a plurality of generally C-shaped links which links are woven into each other. The jewelry rope chain is made with a cutting tool, which includes an extended blade member having a rounded groove therein with a nesting surface conforming to the contours of the material to be cut, such as a jewelry rope chain wire, to form a link, which link may be preferably a semi-solid link, which link has an interior cavity. The semi-solid rope chain has a weight ratio in relation to solid rope chain, wherein the weight ratio of semi-solid chain to solid chain, expressed as a per cent, is from about 50.1% to about 99.9%.

6 Claims, 5 Drawing Sheets

JEWELRY ROPE CHAIN CUTTING TOOL

FIELD OF THE INVENTION

The invention relates to jewelry rope chain with semi-solid links, and a method of producing same.

BACKGROUND OF THE INVENTION

In the last ten years the highest single item volume sale in the jewelry industry has been the so called "hand made rope chain". The manufacturers of this product are in a continuous search for novel products and method of making such rope chains. The present disclosure is directed to a method of cutting the wire forming the rope chain links as well as to a product which becomes accessible and worthwhile to be made automatically as a result of such cut.

The chain manufacturing industries including rope chain machines, which preferably use two types of cutting blade systems for cutting a wire length used further to form a jewelry link, such as a C-shaped link.

One type of cutting system includes a so-called "Guillotine cut" where a sharp HSS steel or carbide knife is pushed and applied against a linear cylindrical wire which is used in forming the links, while the wire rests on a HSS steel or carbide surface.

A second type of cutting system includes a so-called "Scissors cut" where wire is sheared by two surfaces tightly pressed one against the other while one shearing surface, which is called the knife, is moved perpendicularly on a so-called "wire guide".

The wire guide includes two hardened plates where one of the plates has a groove in close tolerance with the size of the wire to be cut.

The most successfully used rope chain assembling All machine is the subject of U.S. Pat. No. 4,503,664 of Allazzetta et al., which uses the aforementioned so-called "guillotine cut".

This type of guillotine cut in Allazzetta '664 allows a solid wire to be cut without an excessive deformation of the wire itself. Therefore a perfectly round solid C-shaped link can be formed as required by the proper functioning of the machine.

For hollow chain links, the type of wire used for the hollow rope chain includes a soft metal core, around which is wrapped a thin plate. When the metal core is removed, the hollow wire, having a gap inside along the wire length, cannot be cut without a significant deformation and crimping of the cross section of the round wire around the cutting area. The resulting C-shaped link is also not suitable for robotic assembling by this machine.

The only possible hollow rope chain to be made so far with this machine is the type of seamless welded tubing having a metal core (preferably iron wire) as described in the background of U.S. Pat. No. 5,129,220 of Strobel. As disclosed, such metal core wire involves a complex manufacturing technologies, so the seamless hollow links are manufactured in limited quantities.

Another technique, sometimes called the "Placatto Method" is used to form hollow chain without using a core wire. In this method, sheet metal forming the hollow tube is reinforced with a non-precious metal sheet such as cooper or cooper alloys by applying pressure and sometimes a film of solder while the sandwich is placed in a high temperature oven. After forming the tube, forming the links, and forming the chain, the non-precious metal is removed with acid.

Yet another sophisticated technique to form hollow chain is the "Agrofato" method which makes use of a non-precious metal core to support the tubular wire forming the chain during cutting and forming the chain links. The precious metal sheet forming the hollow chain tube is wrapped around the non-precious core shaped in such a cross section that after pulling through a round die, the newly formed seamed precious metal tube has a seam filled with the non-precious metal core material. Since this seam has a different color from that of the precious metal outer tube, a servo system using a color sensing optical transducer is used to control spooling of the link wire by continuous adjustment so that the seamed link wire is fed into the chain forming machine in a particular orientation such that the seam is always positioned precisely on the inside of the chain link. This presents an example of the degree of care required to machine form hollow chain using a current technique.

In general, the prior art solid and hollow links each present drawbacks and disadvantages, where it be the extra weight of the gold required for a solid link, or the inability of the hollow wire to withstand cutting without unwanted and undesirable deformation and crimping of the link by the cutting blade.

OBJECTS OF THE INVENTION

It is therefore an object of the present invention to provide a cutting tool for a semi-solid jewelry rope chain so as to permit the practical and efficient cutting thereof without deforming or destroying the material being cut.

It is yet another object of the present invention to provide a cutting tool for semi-solid rope chain having a grooved nest in the blade of the tool.

It is a further object of the present invention to provide a cutting tool for semi-solid rope chain wherein the blade of the cutter has a groove therein which serves as a nest and a protector of the material being cut during the cutting process.

It is also a further object of the present invention to provide a grooved cutting tool for semi-solid rope chain wherein the groove in the cutting tool blade conforms to the contours of the material being cut.

It is yet an object of the present invention to provide a semi-solid jewelry rope chain having a cavity therein such that, in composition, the rope chain falls between jewelry chain which is solid, and thus has no internal cavity, and so-called hollow jewelry rope chain, wherein the walls are extremely thin and the internal cavity very substantial in proportion to the thickness of the outer walls of the rope chain.

It is a further object of the present invention to provide a semi-solid jewelry rope chain which, while requiring less precious metal than a solid jewelry rope chain, is still easily cuttable is a substantially conventional manner by a cutting tool employing a novel grooved blade.

It is also an object of the present invention to provide a jewelry rope chain comprised of C-shaped links wherein the links are comprised of a semi-solid material.

It is an object of the present invention to provide a jewelry rope chain including C-shaped links, wherein the links have a given distance from one end of the C-shape to the other, and wherein the links have a given width diameter, and further where there is a ratio of about 3.5 to about 3.7 in the C-shaped length diameter between then ends of the C-Shape and the width diameter of the link.

It is an object of the present invention to provide a method of making semi-solid jewelry rope chain having C-shaped links with the aforementioned width-length ratio by using a novel grooved blade cutting tool.

It is yet an object of the present invention to provide a semi-solid jewelry rope chain with a weight ratio, expressed in per cent, where the semi-solid chain in comparison to solid jewelry rope chain is from about 50.1% to about 99.9% of the weight of the solid chain.

It is yet a further object to improve over the disadvantages of the prior art.

SUMMARY OF THE INVENTION

In keeping with the foregoing objects of the present invention, and others which may become apparent, this invention is a novel cutting tool for hollow seamed wire in such a way that no significant deformation to the cross sectional area of the hollow wire will be done.

Such a tool will be possible to use in the presently available chain machines on the market as well as in the development of more efficient apparatus for the manufacturing of the links required for the manufacturing of seamed wire hollow rope chain.

The preferred method of cutting for such a tool will be the so-called "Scissor cut" where the cutting knife will have a groove identical in diameter with the outside diameter of the wire. During shearing, the tendency for deformation of the cut edges will be limited by the cutting knife groove thus allowing a clean round edges around the cut.

Furthermore, the cutting tool described in this invention allows the cutting of hollow seamless welded tubing without the requirement of a metal core inside the tube and the laborious job of removing such core.

The purpose of the metal low carbon soft steel core is initially to bring the wall thickness of the tube, during the reduction of the outside diameter of the tube, in the range of 0.02–0.04 mm as required for a hollow rope chain. Second, the metal core seamless tube is also easy to cut by conventional tools in the rope chain machines.

In contrast to the present invention, the hollow rope chain made of seamed wire as described in U.S. Pat. Nos. 5,303,540 of Rozenwasser and 5,125,225 of Strobel includes a thin wall tubing of 0.002–0.004" (0.05–0.1 millimeter).

Dependent on the size of the wire diameter, this wall thickness will result in a hollow chain having 30–40% weight of the chain made of the same diameter solid wire.

Therefore, hollow chain is always under 50% weight of the same diameter solid chain. There is a practical limitation on the plate thickness that can be wrapped around a specific size diameter core wire while pulling through a die.

According to the theory of plate bending it is obvious that with this method one cannot get just any arbitrary small size center hole wire. The new cutting tool of the present invention allows a cost effective automatic manufacturing using seamless tubing without a metal core, to manufacture seamless heavy wall chain having 50% and higher weight of the same diameter solid and retain all the characteristics and qualities of a solid rope chain.

This heavy-walled precious metal seamless tubing for use in the chain forming machine is easily formed using standard tube manufacturing methods often used for other applications such as, for example, making stainless steel tubing for the manufacture of needles for medical syringes. This includes the use of forming rollers, welding and often drawing down through a finishing die.

The way the novel cutting tool works is that it has a groove in it which conforms to the contours of the wire or other material being cut. The groove forms a nest, with a nesting surface protecting the structure and outer surface of the material or wire being cut, when the scissors cut is applied thereto.

Without the protection offered by the groove in the novel cutting tool blade of the present invention, the semi-solid wire would otherwise be subject to deformation in the conventional cutting processes.

In the present invention, the semi-solid material has an inner cavity. The purpose of the inner cavity is to permit a reduced amount of precious metal to be employed in the manufacture of the rope chain.

However, the rope chain of the present invention is intermediate between solid chain, employing a larger and more expensive quantity of precious metal. The hollow chain, employing less precious metal, is unsuitable for cutting with the novel tool of the present invention, since the hollow chain can be easily and immediately deformed and thus destroyed by being cut with the novel tool of the present invention.

The semi-solid chain of the present invention has a weight ratio compared to similar solid chain. The weight ratio may be expressed as a percent, by comparing the semi-solid rope chain with solid rope chain which is otherwise identical in materials and diameter. The semi-solid rope chain of the present invention will have between 50.1% and 99.9% of the weight of the solid chain.

In addition, the rope chain of the present invention includes a plurality of C-shaped links. In order to form the rope chain, the C-shaped links of a semi-solid rope chain have a ratio of length diameter to width diameter of from about 3.5 to about 3.7. The length diameter of the C-shaped link is the distance from one end of the C-shape to the other. The width diameter of the C-shape is the cross-sectional diameter of the semi-solid material comprising the C-shaped link.

Such a semi-solid chain is novel as far as a method of manufacturing and scope. A total new market for semi-solid rope chain, which can be advertised as 50% and higher weight of the same diameter solid rope chain would have. Based on customer demand, any weight between 51% and 99% of the same diameter solid chain can be made, while retaining all of the qualities of the solid chain.

The continuous search for lighter solid chain by altering the preferred ratio of 3.5 of wire diameter to link diameter, to get lighter solid chain is ultimately bringing looser and looser chain to the market with inferior esthetic qualities, would come to an end. Dependent on customer budget, the weight of the chain retaining all the esthetic and mechanical qualities of the solid could be obtained.

DESCRIPTION OF THE DRAWINGS

The present invention can best be described in conjunction with the drawings, in which.

DETAILED DESCRIPTION OF THE PREFERRED EMBODIMENT

Figure 1:
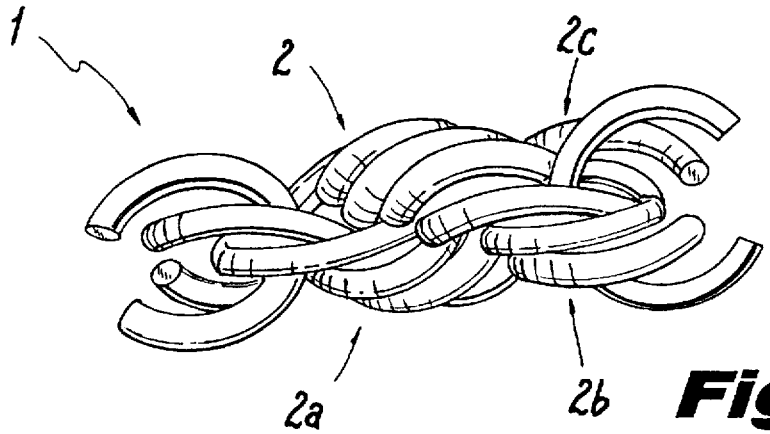
FIG. 1 is a perspective view of a portion of a jewelry chain of the present invention.

As shown in FIG. 1 a portion of a jewelry chain 1 of the present invention includes a plurality of generally C-shaped links 2, 2*a*, 2*b*, 2*c* etc. which links 2, 2*a*, 2*b*, 2*c* etc. are woven into each other.

Figure 2:
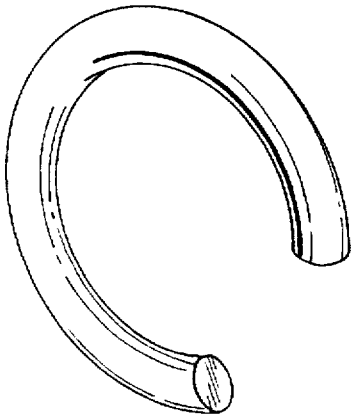
FIG. 2 is a close-up perspective view of a prior art solid link for a prior art jewelry chain with solid links.
Figure 3:
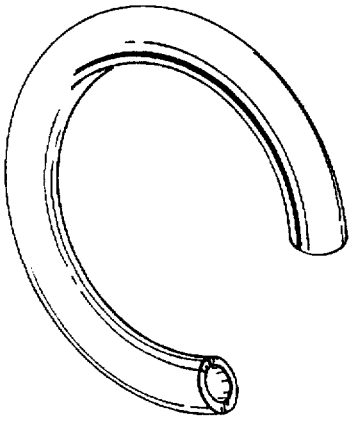
FIG. 3 is a close-up perspective view of a prior art hollow link for a prior art jewelry chain with hollow links.
Figure 4:
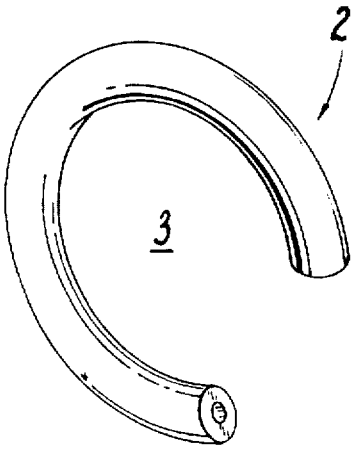
FIG. 4 is a close-up perspective view of a semi-solid hollow link for a the jewelry chain of the present invention with semi-solid links.
Figure 5:
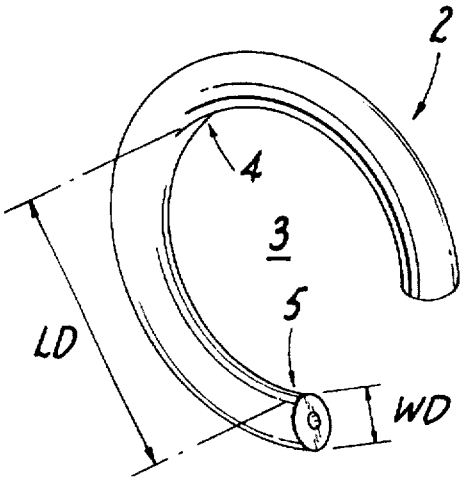
FIG. 5 is a close-up perspective view of a semi-solid hollow link as in FIG. 4, showing width diameter and link diameter of the semi-solid link of the jewelry chain of the present invention with semi-solid links.

As shown in FIGS. 2, 3 and 4, jewelry rope chain 1 is made of C-shaped links, which, as shown in FIG. 5, are subject to certain minimum measurement requirements. For example, each link 2 has a cross sectional diameter labelled "WD" for width diameter, as well as a diameter across the opening around which the link is curved, which is referred to as "LD", or, "length diameter." The LD diameter must have a length that is 3.5 to 3.7 times larger than the WD diameter. If the LD diameter than 3.7, there will be too much air space between the woven links 2, 2*a*, 2*b*, 2*c* etc, making the chain too "loose." If the LD diameter is smaller than 3.5, then the WD diameter is too thick to enable the links 2, 2*a*, 2*b*, 2*c* etc to be inserted within each other.

Figure 6:
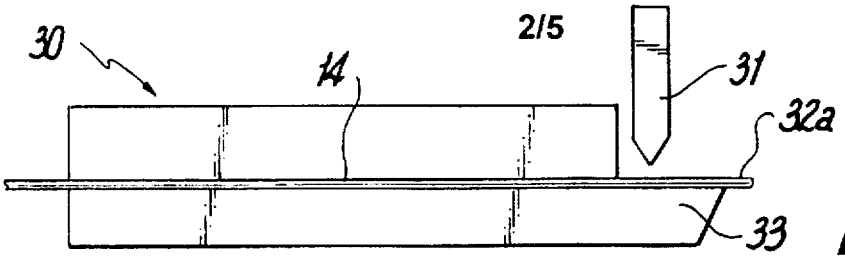
Fig. 6 (PRIOR ART)
FIG. 6 is a side elevational view of a prior art guillotine cut jewelry wire cutting machine for producing solid wire pieces used in producing the prior art solid links as in FIG. 2.

FIG. 6 shows a prior art guillotine cut jewelry wire cutting machine 30 with a knife 31 and a cutting surface 33 for producing solid wire pieces 32*a* used in producing the prior art solid links 32 as in FIG. 2.

Figure 7:
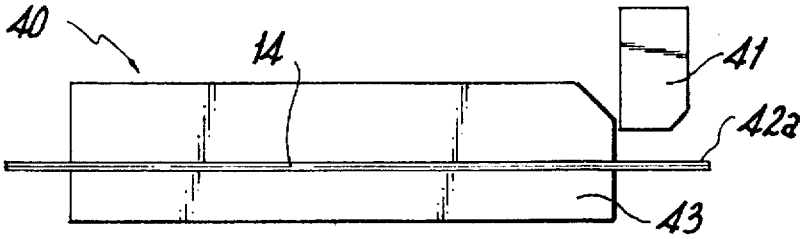
Fig. 7 (PRIOR ART)
FIG. 7 is a side elevational view of a prior art scissors cut jewelry wire cutting machine for producing solid wire pieces used in producing the prior art solid links as in FIG. 2.

FIG. 7 shows a prior art scissors cut jewelry wire cutting machine 40 with a knife 41 and a guide 43 for producing solid wire pieces 42*a* used in producing the prior art solid links 42 as in FIG. 2.

Figure 8:
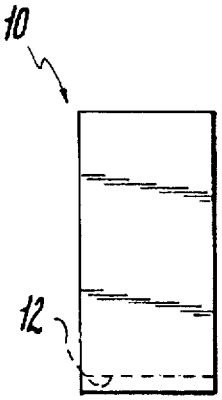
FIG. 8 is a side elevational view of the cutting blade tool of the present invention.
Figure 9:
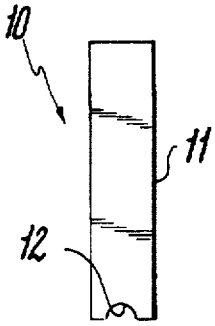
FIG. 9 is a front elevational view of the cutting blade tool of the present invention.
Figure 11:
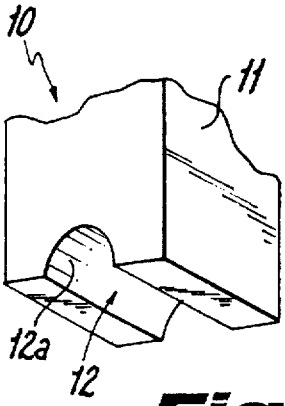
FIG. 11 is a close-up perspective view of the recessed cutting surface of the cutting blade tool of the present invention, as in FIGS. 8–10.
Figure 10:
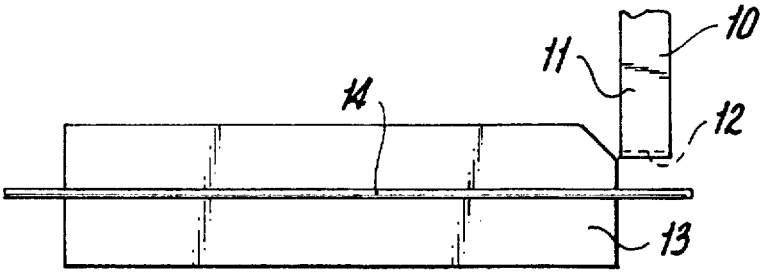
FIG. 10 is a side elevational view of the jewelry wire cutting machine for producing semi-solid wire pieces used in producing the semi-solid links of the present invention, as in FIG. 4.

As shown in FIGS. 8–10, the cutting tool 10 for cutting elongated material on a wire guide 13, includes an extended blade member 11 having a rounded groove 12 therein. The groove 12 includes a nesting surface 12*a* conforming to the contours of the material to be cut, such as a jewelry rope chain wire 14 to form a link 2, which link 2 may be preferably a semi-solid link, which link 2 has an interior cavity 3.

The semi-solid rope chain 1 has a weight ratio in relation to solid rope chain, wherein the weight ratio of semi-solid chain to solid chain, expressed as a per cent, is from about 50.1% to about 99.9%, or preferably having a weight ratio of from about 50.1% to about 60%.

The semi-solid rope chain 1 includes multiple interconnected links 2, 2*a*, 2*b*, 2*c*, etc., which generally are C-Shaped with an interior cavities 3.

Each respective C-shaped link has two ends 4 and 5, and has a width diameter WD comprising a cross-sectional diameter, and wherein each respective link 2 has a length diameter LD wherein LD is substantially the distance between the two ends 4 and 5 of the C-shaped link 2, and wherein further, the ratio of LD to WD, i.e., LD/WD is from about 3.5 to about 3.7.

The present invention also includes a method of making a semi-solid chain 1, which includes the steps of:

a. cutting a elongated semi-solid material 14 by using a tool 10 having an extended blade member 11, the blade member 11 further having a groove 12 therein, the grove 12 including a nesting surface 12*a* conforming to the exterior contour of the semi-solid material 14 to be cut;

b. forming said already-cut semi-solid material 14 into links 2, 2*a*, 2*b*, 2*c*, etc. ; and c. joining said links 2, 2*a*, 2*b*, 2*c*, etc. into a chain 1;

d. wrapping the chain 1 onto suitable lathe means; and e. decorating the chain 1 by applying a shearing tool thereto against the chain 1 to shear off a portion of the semi-solid links 2, 2*a*, 2*b*, 2*c*, etc. to add sparkle, as in a diamond cutting of the chain 1.

The preferred chain link 2 of the chain 1 of the present invention has a weight ratio of from about 50.1% to about 60% of solid, although the ratio may range from 50.1% to 99%.

The blade 10 has a groove 12 in it which conforms to the contours of the wire 14 or other material being cut. The groove 12 forms a nest protecting the structure and outer surface of the material or wire 14 being cut when the scissors cut of blade 10 is applied thereto. Without the protection offered by the groove 12 in the novel cutting tool blade 10 of the present invention, the semi-solid wire 14 would otherwise be subject to undesirable deformation in the conventional cutting processes.

Figure 12:
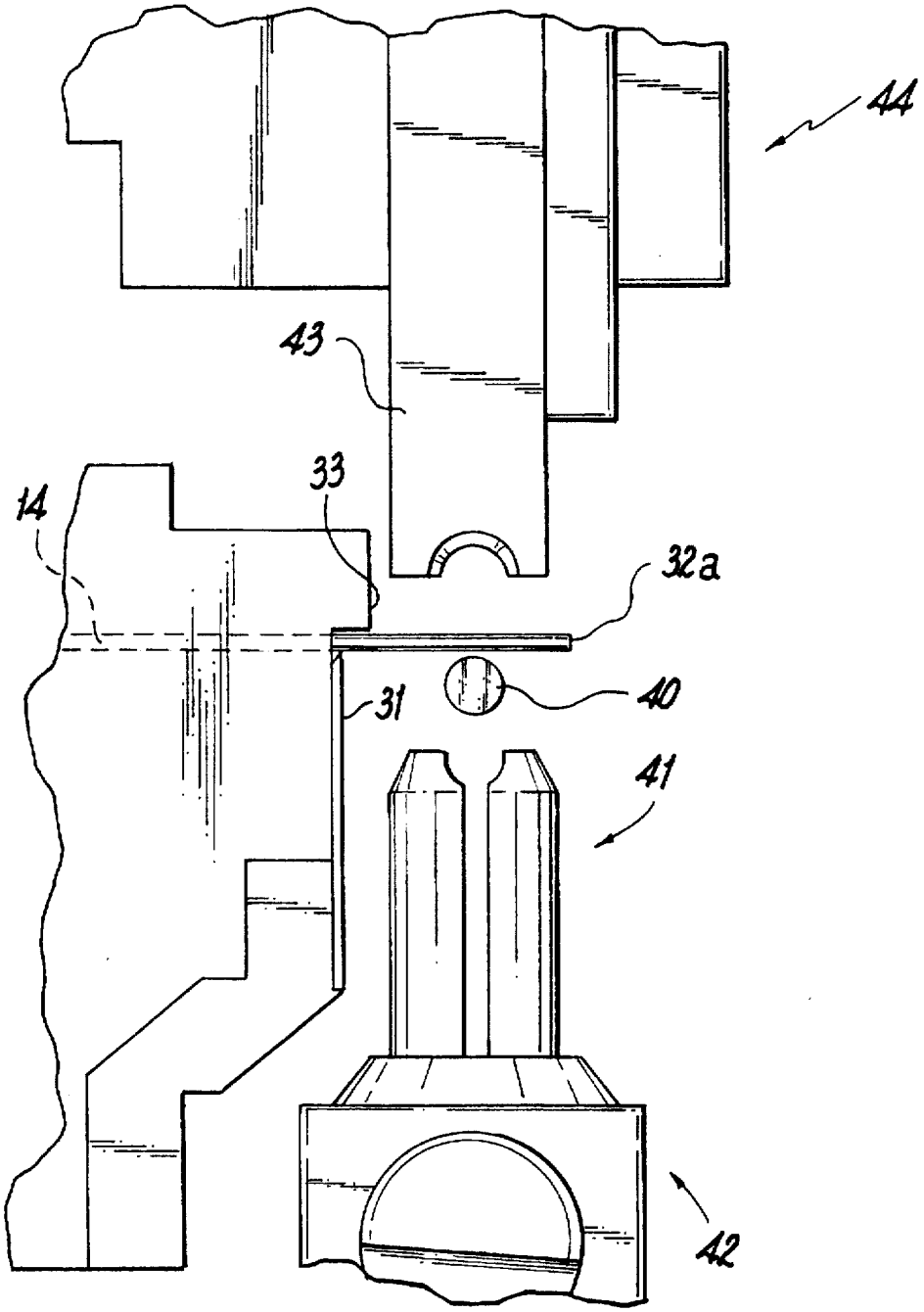
Fig. 12 (PRIOR ART)
FIG. 12 is a side view elevation of the cutting and forming portion of a prior art chain forming machine showing a guillotine cutting mechanism.

FIG. 12 shows a close-up of the cutting and forming portion of the prior art chain making machine. This machine can be used with solid wire or with hollow chain wire with a core. Note that a guillotine knife 31 is used against an HSS surface 33.

Figure 13:
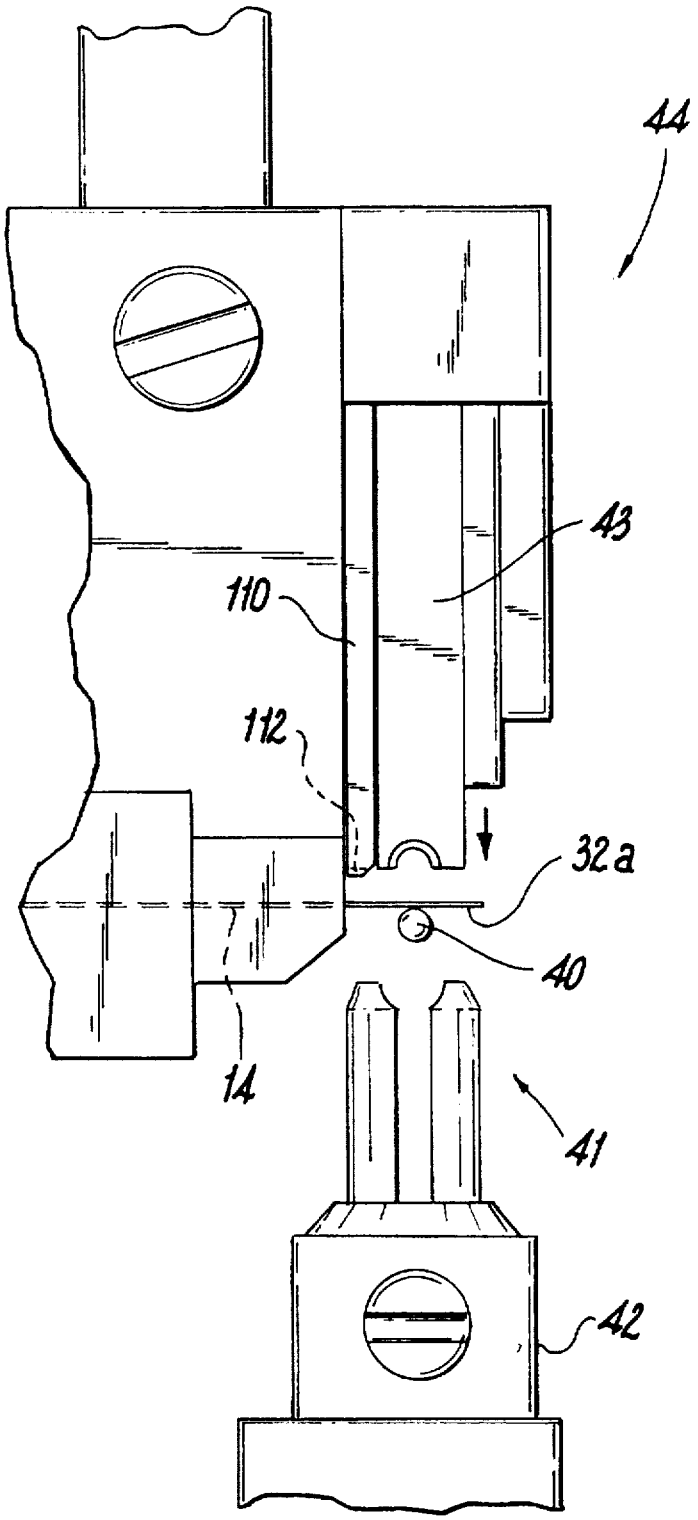
FIG. 13 is a side view elevation of the cutting and forming portion of the chain forming machine using the grooved knife performing a scissor cut.

FIG. 13 shows a similar detail of the chain making machine updated with the grooved cutting tool 10 and the scissor cutting method. There is no HSS surface under the wire in the vicinity of the knife or the cutting tool. As in the prior art machine, synchronization of the cutting, forming and wire advance mechanisms is by virtue of cams and gears.

Figure 14A:
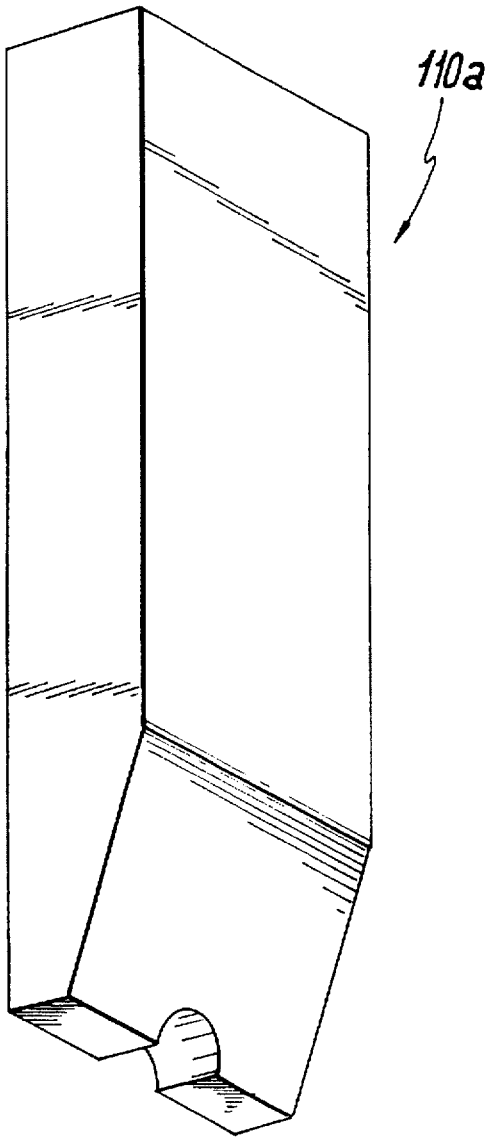
FIG. 14 shows an isometric view and an end view of the grooved knife or cutting tool.
Figure 14B:
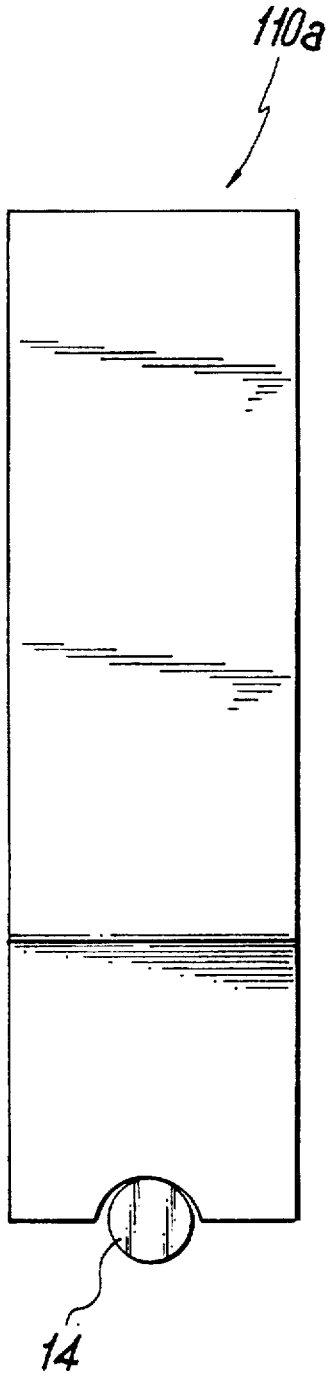

FIG. 14 shows an isometric view of the knife 10 as well as an end view. The minimum depth of the cutting groove is shown to be half the wire diameter plus 0.02 mm. The width of the groove is shown to be the wire diameter plus 0.01 to 0.03 mm.

It is therefore noted that other modifications may be made to the present invention, without departing from the spirit and scope of the present invention, as noted in the appended claims.

I claim:

1. A method of making a semi-solid chain, comprising the steps of:

a. cutting an elongated semi-solid wire by using a tool having an extended guillotine blade member, the blade member having means for cutting and protecting the wire being cut from deformation of the cross sectional area of said semi-solid wire comprising a groove formed in said blade member having a nest conforming to the contours of the semi-solid wire to be cut, said semi-solid wire having a central axis opening and being such that the weight ratio of said wire is in the range of about 50.1 to 99% of the wire when solid and the wall thickness of said wire being of sufficient thickness to be resistant to deformation by the application of blunt force thereto;

b. forming said already-cut semi-solid wire into links; and c. joining said links into a chain.

2. The method of claim 1 further comprising the steps of:

d. wrapping the chain onto suitable means; and e. decorating the chain.

3. The method of claim 2 wherein the suitable means comprises a lathe.

4. The method of claim 2 wherein the decoration comprises diamond cutting of the chain.

5. Cutting tool apparatus in combination with and for cutting semi-solid jewelry wire chain comprising:

a. a length of jewelry wire to be cut and formed into C-shaped links, said wire being of solid material with a central axial opening therethrough, the size of said central axial opening being such that the weight ratio of said wire is in the range of about 50.1 to about 99% of the wire when solid and the wall thickness of said wire being of sufficient thickness to be resistant to deformation by the application of blunt force thereto; and b. guillotine blade means for cutting said wire comprising a solid blade member having an extended body with a flat rectangular shaped bottom surface facing said wire, said flat bottom surface having means for cutting and protecting the material being cut from deformation of the cross sectional area of said wire comprising a flat, concave groove in said surface whose curvature matches the outer surface of said wire to be cut to permit said wire to nest in said groove as cutting takes place.

6. The apparatus of claim 5 in which each of said links is formed into a C-shaped member having a cross sectional diameter and a length diameter, the length diameter being 3.5 to 3.7 times larger than the cross sectional diameter.

* * * * *